US005388985A

United States Patent [19]

Musil et al.

[11] Patent Number: 5,388,985

[45] Date of Patent: Feb. 14, 1995

[54] BURNER ASSEMBLY WITH FUEL PRE-MIX AND COMBUSTION TEMPERATURE CONTROLS

[75] Inventors: Joseph E. Musil, Ely, Iowa; Lawrence G. Clawson, Dover, Mass.

[73] Assignee: Cedarapids, Inc., Cedar Rapids, Iowa

[21] Appl. No.: 994,714

[22] Filed: Dec. 22, 1992

[51] Int. Cl.[6] ..... F23L 13/00

[52] U.S. Cl. ..... 431/116; 431/2; 431/12; 431/350

[58] Field of Search ..... 431/116, 2, 4, 5, 8, 431/9, 12, 115, 350, 254

[56] References Cited

U.S. PATENT DOCUMENTS

| | | | |
|---|---|---|---|
| Re. 29,496 | 12/1977 | Dydzyk . | |
| 3,652,194 | 3/1972 | Bailey . | |
| 3,705,784 | 12/1972 | Reichhelm et al. . | |
| 4,298,337 | 11/1981 | Butler et al. . | |
| 4,600,377 | 7/1986 | Musil . | |
| 4,995,807 | 2/1991 | Rampley et al. | 431/9 |
| 5,092,761 | 3/1992 | Dinicolantonio . | |
| 5,102,328 | 4/1992 | Robinson . | |
| 5,145,359 | 9/1992 | Anacona et al. . | |
| 5,154,596 | 10/1992 | Schwartz et al. . | |
| 5,192,204 | 3/1993 | Musil . | |
| 5,275,554 | 1/1994 | Faulkner | 431/9 X |

FOREIGN PATENT DOCUMENTS 2123945 2/1984 United Kingdom .

*Primary Examiner*—Larry Jones

*Attorney, Agent, or Firm*—Simmons, Perrine, Albright & Ellwood

[57] ABSTRACT

A burner assembly has a combustion chamber in which combustion takes place in an elongate centrally disposed combustion tube. An outer housing encases the combustion tube and provides an annular space between an inner wall of the housing and the combustion tube. Part of the exhaust gases exiting from the combustion tube are diverted from the downstream end thereof to be returned through the annular space to the upstream end of the combustion tube. Fuel is injected into the diverted exhaust gases, volatilized when in liquid form and mixed with the diverted gases. The fuel and gas mixture is further combined with a buffer gas and becomes entrained into and mixed with a high velocity of combustion air which is injected into the upstream end of the combustion tube. The flame temperature may be monitored and the quantity of the buffer gas added may be controllably varied based on temperature readings from the monitoring process to minimize the generation of nitrous oxides.

19 Claims, 4 Drawing Sheets

BURNER ASSEMBLY WITH FUEL PRE-MIX AND COMBUSTION TEMPERATURE CONTROLS

BACKGROUND OF THE INVENTION

1. Field of the Invention

This invention relates generally to burner assemblies and more particularly to burner assemblies with provisions for injecting liquid fuel and dispersing the fuel within combustion air.

2. Discussion of the Related Developments

Burner assemblies, for example those that may be used for aggregate drying operations, are frequently operated with industrial types of liquid fuels, such as a burner grade diesel oil or even special heating oil of a grade heavier and more viscous than diesel oil. State-of-the-art turbo-burner assemblies include fuel induction systems which disperse the liquid fuel in form of fine droplets into a stream of combustion air and allow the fuel droplets to mix with the air before the mixture of fuel and air is ignited and burned.

Combustion of the fuel takes place only after the fuel in each of the droplets is vaporized. The smaller the droplets of fuel, the more uniformly and efficiently the combustion appears to proceed. In state-of-the-art fuel "atomizing" or dispersion provisions, small droplets of the fuel become interspersed with the combustion air. As a mixture of fuel droplets and the combustion air moves toward the "flame region" of the burner, the heat of the standing flame begins to vaporize the fuel. The smaller the droplets, the greater is the surface area of the droplets in relation to its mass volume and the faster is the rate at which the fuel vaporizes. Once the fuel is vaporized, combustion of the fuel occurs with stoichiometric amounts of oxygen supplied by the combustion air. However, combining a measured quantity of liquid fuel with combustion air having a stoichiometrically correct supply of oxygen is typically found to result in incomplete combustion and in emissions of hydrocarbons and unburned oxygen. With the addition of excess air, such as is done in state-of-the-art systems, to raise the oxygen supply above that of the stoichiometric oxygen, more complete combustion results and the hydrocarbon content in the emission products tends to decrease. But the more complete combustion also results in higher flame temperatures and undesirable nitrous oxides tend to appear in increasing concentrations in the emitted combustion gases. Ideal combustion results in a "blue flame" combustion. Though optimizing adjustments in the fuel to air ratio are made, experience shows that some unburned hydrocarbons remain and some nitrous oxides ($NO_x$) are generated during the combustion process. The generation of nitrous oxides typically occurs in excessive amounts at flame temperatures above 2,200 degrees Fahrenheit.

The emission into the atmosphere of either hydrocarbons or nitrous oxides is in any case undesirable and may, if the emission of either hydrocarbons or nitrous oxides is excessive, violate prescribed clean air requirements. With increased public awareness of the desirability of limiting air pollution, a continuing need exists for improvements in existing commercial burner systems to further reduce the levels of undesirable emissions of hydrocarbons or nitrous oxides or both.

DISCUSSION OF THE INVENTION

Problems with controlling concentrations of polluting products in emissions from "high capacity" burner units, such as turbo-burners used for drying aggregate products, appear to be related to non-uniformities in the distribution of combustion elements within the combustion mixture. If, within the mass of the mixture, each droplet is regarded as a discrete fuel source, then a region about each droplet becomes a discrete combustion region which contributes incrementally to the overall combustion process.

On a molecular scale, each such fuel droplet, no matter how small, constitutes a concentration of a great number of fuel molecules with respect to surrounding oxygen molecules ($O_2$) in the fuel to air mixture. It appears that within the brief period during which combustion takes place, the combustion of such local fuel molecule concentrations brings about respective local zones of oxygen depletion, resulting in a tendency of some fuel elements not being able to combine with oxygen while the bulk of the gases undergo combustion.

The present invention addresses the described problem of nonuniform combustion and of resulting air pollutants by first volatilizing liquid fuel and then mixing the volatilized fuel with stoichiometric amounts of oxygen supplied by an appropriate amount of combustion air. Combustion takes place in a "standing flame" region of a burner assembly only after the volatilized fuel and the air become fully intermixed. A substantially blue flame combustion process may be obtained by substantially complete mixing of the fuel and combustion air. It has been found that it is possible to apply the described sequence of steps to high capacity burners for aggregate material type dryers and the like, to obtain a blue flame and, therefore, substantially complete combustion of a supplied fuel without a need to add excess oxygen. However, even when combustion takes place with premixed fuel and oxygen gases, the tendency of the combustion gases to form nitrous oxides still needs to be controlled.

In light of the above considerations relating to the invention and to the problems to be addressed by the invention, it is an object of the invention to provide a burner assembly with a device for volatilizing liquid fuel and for mixing the volatilized fuel with stoichiometric amounts of oxygen before igniting the fuel and oxygen mixture in a combustion region of the burner assembly.

Another object of the invention is to provide a burner assembly which includes a provision for separating a portion of the hot combustion gases from a mainstream of combustion gases and a provision for mixing liquid fuel with the separated hot combustion gases to carry the liquid fuel within the separated gases during the volatilization of the fuel.

A further object of the invention is to provide a burner assembly with a capability to entrain a heated gas and fuel at a predetermined rate within a stream of combustion air.

Yet another object of the invention is to provide a burner assembly with an adjustment for changing a rate at which a hot, oxygen depleted combustion gas and volatilized fuel becomes entrained into the stream of atmospheric combustion air.

It is another object of the invention to provide a controlled amount of oxygen depleted buffer gas to mix with volatilized fuel and become dispersed throughout a stream of combustion air to limit the generation of nitrous oxides.

It is yet another object to provide a burner for the homogeneous combustion of fuel in a controlled environment resulting in the generation of reducing combustion gases or products.

Various advantages and features of the invention in accordance herewith will become apparent from the further description of the invention and from the description of the described preferred embodiments thereof which may be read in reference to the appended drawings.

SUMMARY OF THE INVENTION

In accordance with the invention, a burner assembly includes an elongate combustion chamber. A combustion tube is disposed centrally and extends longitudinally within the combustion chamber. The burner assembly includes a blower assembly for generating a stream of combustion air through the combustion tube. A provision for generating a mixture of fuel and oxygen for homogeneous combustion in the combustion tube includes a provision for injecting fuel into a stream gas including heated combustion gases to volatilize the injected fuel. A provision disposed at the entrance of the combustion tube entrains the mixture of the injected fuel with oxygen depleted heated gas into the stream of combustion air entering the combustion tube.

According to one aspect of the invention, the mixture of fuel and oxygen may be controlled to vary over a range of mixtures from an excess of fuel vapor, to a stoichiometric mixture, or even to a mixture including an excess of combustion air. When burned in accordance with the provisions, generation of undesirable pollutants, such as nitrous oxides, is controlled.

According to another aspect of the invention the provision for entraining pre-burned combustion gases with unburned fuel and turbo combustion air includes a venturi flow generator at the entrance of the combustion tube. An annular opening adjacent the flow generator for admitting and entraining the pre-burned gases is preferably adjustable to generate a desired stoichiometric mixture of volatilized fuel and oxygen within the combustion tube.

BRIEF DESCRIPTION OF THE DRAWINGS

The Detailed Description below may be best understood when read in reference to the accompanying drawings wherein.

DETAILED DESCRIPTION OF THE INVENTION

1. The Burner Assembly

Figure 1:
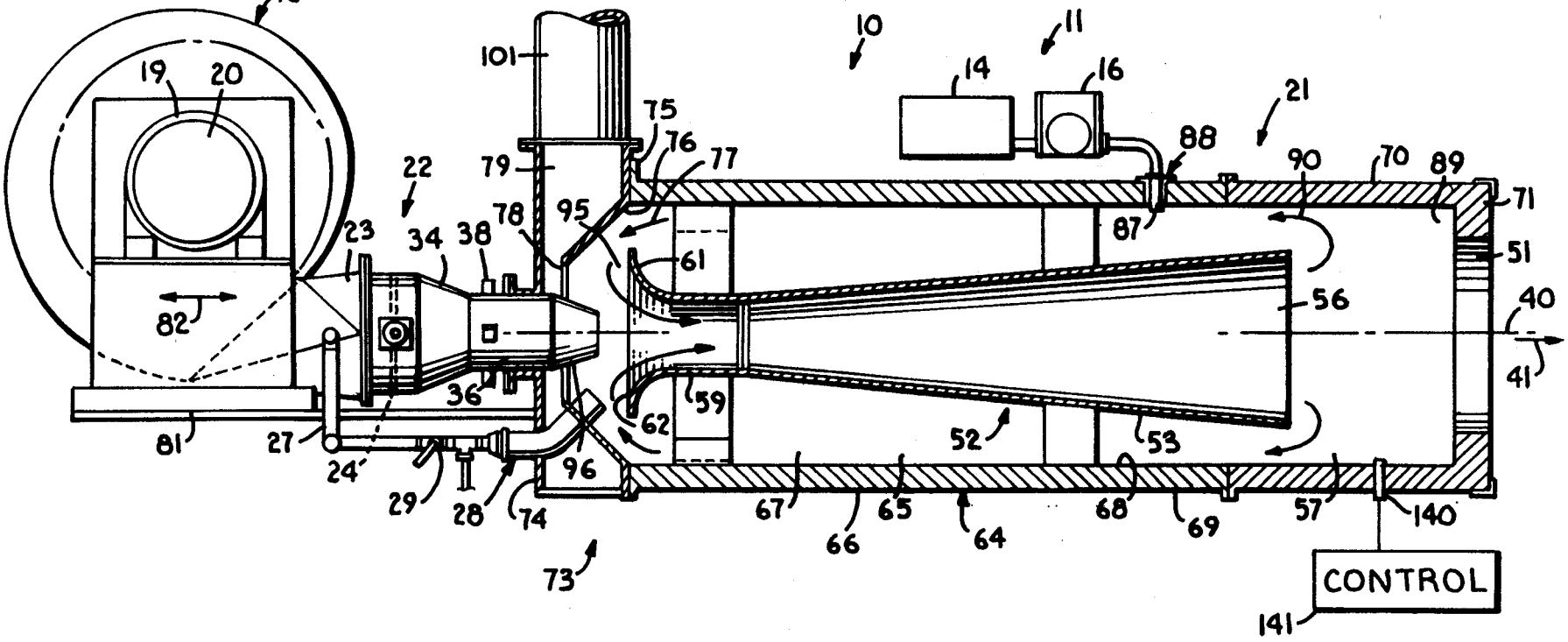
FIG. 1 is a simplified sectional view through a burner assembly of a burner system which incorporates features of the present invention.

FIG. 1 shows a cross section through a burner assembly designated generally by the numeral 10. The burner assembly is a major component of a burner system 11. The burner system 11 described herein as an embodiment of the invention may be a "high capacity" burner system having an energy generating capacity of at least twenty million BTU (British Thermal Units), and as high as two hundred million BTU, such as is typical for heating bulk products such as aggregate materials in an asphalt production plant, as shown schematically in FIG. 2.

In reference to FIG. 1, the burner system 11 includes the burner assembly 10, a fuel supply shown schematically at 14, a fuel metering and injection pump 16. The burner assembly 10 is characterized as a turbo-burner assembly and includes a turbo-blower 18 for providing a stream of primary combustion air. The turbo-blower 18 includes a housed, centrifugal fan 19 which is typically driven by an electric motor 20. The housed, centrifugal fan 19 is capable of moving a substantial volume of air with a substantial pressure head with respect to ambient, atmospheric air. As an example, a turbo blower unit 18 of a burner assembly 10 having a maximum energy generating capacity of two hundred million BTU may be used to advance, for example, 34,000 cubic foot of air per minute at a pressure of up to thirty ounces per square inch to a combustion chamber 21 of the burner assembly 10. A transition section 22 coupled to an outlet 23 of the turbo blower unit 18 directs air into the combustion chamber 21. A turbo air damper 24 is disposed within the transition section 22. The damper 24 is preferably an adjustable shutter type damper and is used to control the supply of combustion air to the combustion chamber 21. Another function of the damper 24 is to generate a pressure drop of combustion air at the outlet of the turbo blower 18 with respect to the air directed into the combustion chamber 10. The pressure head of the combustion air as sustained at the outlet 23 from the turbo blower may be used, as shown with respect to the described embodiment, to supply combustion air through a supply pipe 27 to a pilot burner assembly 28. The pilot burner assembly 28 includes a typical air shutoff valve 29, a preferred LP fuel type pilot flame holder 31 and a pilot flame injector tube 32. The transition section 22, according to the described embodiment, may include a flow converging section 34 ahead of an air injector nozzle 36 which further increases the exit velocity of the combustion air as it exits through the air injector nozzle 36 into the combustion chamber 21. The described structure of the turbo blower 18 consequently generates a high velocity stream of combustion air which is injected in a highly directional stream into the combustion chamber 21.

Figure 3:
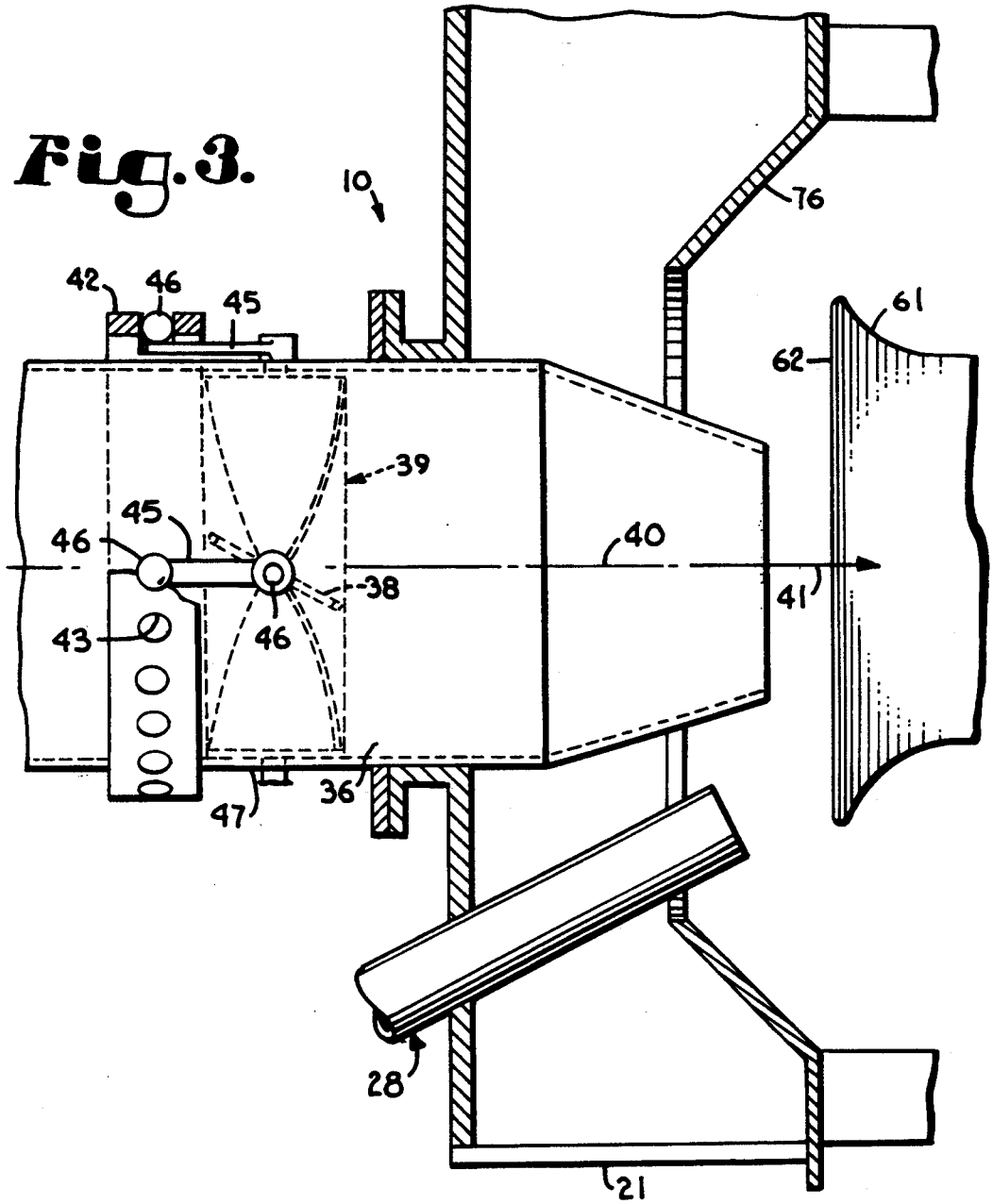
FIG. 3 is an enlarged partial view of the burner assembly shown in FIG. 1, showing an upstream end of the burner assembly in greater detail.

Referring to FIGS. 1 and 3, stator type spin vanes 38 of a spin vane assembly 39 are in a preferred embodiment radially disposed within the air injector nozzle 36 to impart to the combustion air a component of rotational motion about a longitudinal axis 40 of the burner assembly 10 just before the air exits into the combustion chamber 21. A pitch angle of the spin vanes 38 with respect to the axial flow direction (see arrow 41) of the combustion air may be adjustable by a single ring 42 disposed about the air injector nozzle 36. The ring 42, as shown in FIG. 3, has a plurality of circumferentially spaced circular bearing seats 43. An outer end 44 of an adjustment arm 45 is retained by each of the seats 43. Each respective one of the adjustment arms is pivotally attached to an adjustment shaft 46 of a corresponding outer end of each of the spin vanes 38. The adjustment shaft 46 protrudes through an outer shell 47 of the air injector nozzle 36.

The combustion chamber 21 of the burner assembly 10 is, in the embodiment of FIG. 1, an elongate cylindrical vessel within which the fuel and combustion air become mixed, the mixture is ignited and the combustion process is substantially completed. Thus, within the confines of the combustion chamber 21, the hot gases are generated which then exit from the chamber 21 through an exit port 51 to perform a heating function, such as heating and drying aggregate materials, for example. It is to be understood that as long as the combustion gases maintain the energy level close to the flame temperature, disassociations and recombinations among elements of combustion may still continue on a limited scale. Hence, the "plume" of what constitutes the flame may extend through the opening 51 as the burned gases exit at high velocity from the combustion chamber 21.

A combustion tube 52 is disposed longitudinally within the combustion chamber 21 and is centered on the longitudinal axis 40. The combustion tube has a generally conically shaped wall 53 which tapers outward in the direction of the gas flow through the combustion chamber 21. An exemplary workable angle of taper of the conical wall 53 is seven degrees of taper with respect to the longitudinal axis 40. Reasonable deviations from such a taper will be found acceptable or may even be desirable in configuring the shape of a combustion tube. A downstream or end 56 of the tube 52 terminates with its opening at a normal flame region 57 of the combustion chamber 21. A central throat portion 59 of the combustion tube 52 may be generally cylindrical in shape, while at an upstream end 61 the combustion tube 52 terminates in a curved outward flared bell with an opening 62 similar to the front portion of a trumpet. The material of the combustion tube 52 is a ⅜ inch thick, high temperature resisting stainless steel (312L). The diameter of the preferably circular section of the combustion tube 52 at the downstream end 56 is substantially less than an inner diameter of an outer housing 64 of the combustion chamber 21. The difference in dimensions of the combustion tube 52 and the outer housing 64 result in an annular enclosed space 65 along the length of the combustion tube 52. A major wall portion 66 of the outer housing 64 encasing a front region 67 of the chamber 21 may be of a compound, fiberglass insulated stainless steel wall structure. An inner wall 68 of preferably ¼ inch thick 316L type stainless steel sheet is outwardly surrounded by an insulating material 69 that may be commercially obtained under the trade designation "Carborundum Fiberfax". A rear or downstream wall portion 70 of the outer housing 64 encases the flame region 57 and is subjected to the hot flame and the hot combustion gases as they exit from the combustion tube 52. The downstream wall portion 70 of the outer housing 64, consequently, would consist preferably of "green castable" ceramic tile material. The exit port 51 at the downstream end of the wall portion 70 of the outer housing 64 is smaller in diameter than an inner diameter of the cylindrical wall portion 70, such that an annular ledge 71 is formed. The annular ledge or wall 71 closes off a radially outermost portion of the downstream end of the combustion chamber 21.

An upstream end 73 of the outer housing 64 of the combustion chamber 21 is capped off by an intake and return shroud 74. The shroud 74 may be preferably attached circumferentially to a flange 75 of the outer housing 64. Besides sealing off the upstream end 73 of the outer housing 64 and, hence, of the combustion chamber 21, the shroud 74 serves two other major functions. A frustum type conical wall 76 of the shroud 74 does close off a substantial annular portion of the upstream end of the combustion chamber 21. However, the conical wall 76 also functions as a guiding surface for turning a flow of gases from the annular space 65 toward the opening 62 of the combustion tube, as indicated by an arrow 77 in FIG. 1. A central opening 78 in the conical wall 76 has a diameter greater than an outer diameter of the air injector nozzle 36. Thus, with the air injector nozzle 36 extending centrally through the opening 78 of the shroud 74, an annular space of the opening 78 remains to 4 communicate between an antechamber 79 of the shroud 74 and the combustion chamber 21. The turbo blower unit 18 may be slidably mounted on an adjustment frame 81 to be moved into a desirable one of various adjustment positions in a direction along the longitudinal axis 40 of the burner assembly 10 either away or toward the opening 62 of the combustion tube 52, as indicated by an arrow 82 in FIG. 1. A preferably flanged opening 85 slidably receives the air injector nozzle 36 of the turbo blower 18. An annular seal 86 preferably closes off a sliding clearance between the air injector nozzle 36 and the opening 85. Sliding the blower unit 18 toward the combustion tube 52 tends to decrease the quantity of diverted heated gases which return through the annular space 65 to become entrained in the high velocity stream of combustion air exiting from the air injector nozzle 36.

A preferred liquid fuel supply system is shown in FIG. 1 by the fuel reservoir 14 and the fuel metering and injection pump 16. Various systems for introducing liquid fuel into a burner are known, most of which include provisions for "atomizing" the fuel, hence, for dispersing fuel in form of fine droplets into a stream of combustion air. The location for introducing liquid fuel is selected to allow for substantial vaporization of the fuel before it is moved to the flame region 75 within the combustion chamber 21. The liquid fuel to supply the burner assembly 10 is injected, preferably also in the form of droplets, through a typical injection tube 87 of an injector assembly 88 into the annular region 65 between the combustion tube 52 and the 4 outer housing 64. The injector assembly is preferably removably mounted to the outer housing 64 to extend through the wall of the outer housing 64 into the combustion chamber 21. Alternate positions for injecting the liquid fuel into the combustion chamber 21 may be selected, particularly since the position of the injector assembly 88 as shown in FIG. 1 provides the longest possible path before the injected fuel reaches the desired flame region 57.

2. The Operation of the Burner Assembly

Further in reference to FIG. 1, the ledge 71 forms with the remaining downstream wall portion 70 of the outer housing 64 an annular stagnation region 89 about a main flow volume of the combustion gases exiting from the downstream end 56 of the combustion tube 52 and advancing through the flame region 57 out of the combustion chamber 21. The stagnation pressure of the gases in the annular region 89 is believed to contribute to a diversion of a portion of the combustion gases emanating from the end 56 into the annular region 65 between the combustion tube and the outer housing of the combustion chamber 21. The beginning of the flow pattern of the diverted portion of the combustion gases is indicated by arrow 90. A reverse flow pattern of the diverted gases with respect to the general flow in the direction of arrow 41 of the combustion gases is furthered by a venturi effect in an entrainment region 95 at the upstream opening 62 of the combustion tube 52. The venturi effect entrains the pre-burned diverted gases and the injected fuel into stream of combustion air. The trumpet-shaped flare of the upstream or front end 61 interacts with the conical wall 76 and a preferably convergingly tapered front end 96 of the air injector nozzle 36 to guide the pre-burned recirculating gases and the fuel into the combustion tube 52. The relatively high velocity of the stream of combustion air enhances a venturi effect by the combustion air as it exits from the air injector nozzle 36 and enters the front end 61 of the combustion tube 52.

An adjustment of the axial position (in the direction of the longitudinal axis 40) of the front end 96 of the air injector nozzle 36 changes a cylindrical surface area about the stream of combustion air entering the combustion tube 52. The extent of the cylindrical area relates to the amount of the diverted gases that become entrained within the combustion air exiting from the air injector nozzle 36. The entrainment of the diverted gases lowers the gas pressure in the annular entrainment region 95 to further induce a return flow of diverted gases from the annular region 65 about the combustion tube 52 into the tube in the direction of the main stream of combustion air and gases through the tube 52. The hot, diverted gases are not merely used to further the vaporization of injected fuel. The diverted gases also function as a buffer medium to disperse the fuel molecules and to enhance mixing of the fuel with combustion air. The travel from the injector assembly 87 to the entrainment region at relatively low gas velocity compared to the velocity of gas flow through the combustion tube 52 provides significant time or distance within which the fuel droplets or fuel gas molecules may become dispersed throughout the diverted gases. The reverse flow with respect to the flow direction of the combustion gases (see the arrow 41) in essence provide a flow length for such dispersion of fuel within the combusted gases which doubles the length of the combustion tube 52 to achieve maximum dispersion. The reverse flow length may be used when the overall length of the combustion chamber 21 is for space reasons kept at a minimum and the injected fuel has added time to disperse and volatilize before reaching the flame region 57.

The physical state of the diverted gases needs to be considered in locating the fuel injector assembly 88. The referred to angle of the combustion tube 52 is such that under normal burner settings and gas flow settings, the beginning of the flame region is sustained well toward the end of the downstream tapered portion 53 of the combustion tube 52. Thus, combustion of the fuel and air mixture would be still in progress as the combustion mixture and gases exit from the combustion chamber 21. The diverted gases are at substantially their highest temperature as they enter the annular space 65 between the combustion tube 52 and the outer housing 64. Injection of the fuel into the hot diverted stream of combustion gases may be desirable only for fuels with highest in a range of volatilization temperatures. Injected fuel is heated immediately by the diverted gases and becomes vaporized, the process of vaporization requiring energy. The energy is taken from the diverted gases, the energy transfer tending to lower the temperature of the diverted gases. However, any standing flame within the combustion tube tends to heat the wall portion 53 of the combustion tube 52 and supply further energy to the evaporating fuel and the returning gases. The position of the fuel injection assembly 88 as shown in FIG. 1 may be advantageous primarily for fuel oils with extreme vaporization energy requirements. For liquid fuels having a lower vaporization temperature or requiring less energy to vaporize, the location of the fuel injection assembly 88 may advantageously be shifted closer toward the upstream opening 62 of the combustion tube 52. It is desired that after injection of the liquid fuel and after it has been at least partially vaporized, the temperature of the mixture of fuel and gases in the annular region would remain below the combustion temperature of the fuel. Incomplete combustion of the diverted gases and the mixture of fuel may have resulted in a substantial depletion of free oxygen within the volume of the diverted gases within the annular region 65. However, the raised temperature of the fuel, hence the energy state of the fuel, renders the injected fuel ready for combustion, except for the substantial absence of available oxygen from the mixture of vaporized fuel and the diverted gases. On becoming entrained in the combustion air and contacting the oxygen molecules of the air, combustion of already vaporized fuel is readily initiated. Any remaining liquid fuel vaporizes as the combustion air and fuel travels toward the flame region 57. The velocity of the combustion air in the throat portion 59 exceeds the flame progression speed or velocity of the combustion process, causing the flame to occur away from the air injector nozzle 36 at a standing flame position adjacent the downstream end 56 and within the combustion tube 52 proper.

Nitrous oxide generation in the combustion process may be controlled by adding a carbon monoxide rich buffer gas to the mixture of the diverted gas and the volatilized fuel as described herein. The antechamber 79 is coupled to a supply duct 101 through which such a buffer gas may be supplied to the mixture of the volatilized fuel and the diverted combustion gas. A forward adjusting movement of the air injector nozzle 36 toward the combustion tube 52 tends to choke off the extent of the diverted gas flow through the annular region 65. Without a change in the rate of the fuel injection, the fuel to gas mixture becomes enriched, however the buffer gas entering the entraining region from the antechamber 79 through the opening 78 supplements the gas being entrained into the stream of combustion air exiting from the air injector nozzle 36. The buffer gas may be oxygen poor or depleted, cleaned exhaust gas, a pre-burned gas which may be diverted from the exhaust of an aggregate heating process as shown in FIG. 2.

3. An Industrial Application of the Burner Assembly

Figure 2:
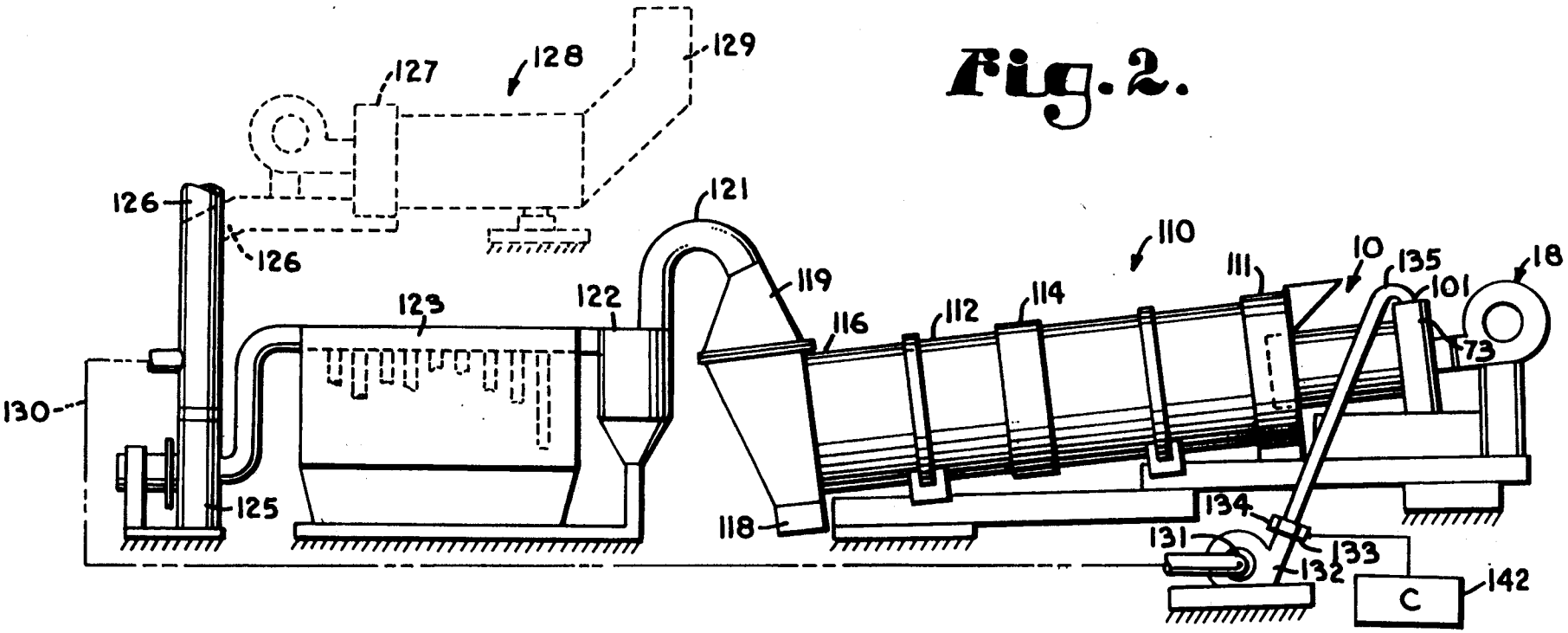
FIG. 2 is a schematic representation of an aggregate drying apparatus as a preferred example of an environment to which the present invention advantageously applies, the schematic representation showing particular features of the present invention, and showing also an alternate embodiment which includes a desirable afterburner.

The described burner assembly 10 is applied advantageously to any one of a number of industrial process applications, as, for example, a soil decontamination process or an aggregate drying operation, shown schematically in FIG. 2 as an example. A parallel flow drum dryer and mixer apparatus 110 is shown. At a raised, upstream end of the apparatus 110 the burner assembly 10 is axially aligned with and directed through an material feed port 111 into a typical, rotatably mounted drum 112. Additional material of a more heat sensitive disposition, such as recycle aggregate, may be added via an intermediate feed port 114 to the material already in the drum 112. Adjacent a discharge end 116 of the drum the material would be mixed with liquid asphalt and the mixed product be discharged as hot asphalt mix through a discharge port 118 at the discharge end of the apparatus 110. Exhaust gases from the summarized operation are drawn off through an exhaust chamber 119 also immediately downstream of the discharge end 116 of the drum 112. Ducting 121 routes the exhaust gases routinely through a primary dust separator, such as a cyclone separator 122 and from there to a state-of-the-art filter house 123. Substantially all entrained dust or material particles which may have become entrained within the gas stream passing through the apparatus 110 will be removed by the sequential application of the primary dust separator 122 and the filter house 123. An exhaust blower 125 draws the filtered gases from the filter house 123 and advances the gases toward typical exhaust ducting 126. In one embodiment of the invention, the exhaust ducting 126 may be an exhaust stack 126 venting the filtered gases to the atmosphere. Particulate matter is removed from the gases at this time. The exhaust has cooled substantially from its initial, heated state, and is considered clean except for the possibility of the existence of unburned hydrocarbon gases and nitrous oxides that might have been generated. The generation of these gaseous pollutants, however, is thought to be minimized or substantially avoided by the features of the burner assembly 10 as described herein.

As an alternate routing of exhaust gases from the filter house 123, the ducting 126 may lead directly to an antechamber 127 of a second burner assembly 128. The second burner 128 is referred to as an afterburner 128. The afterburner 128 as used in a commercial process as described herein, burns combustible elements from exhaust gases before they are released into the atmosphere. These combustible elements may be carbon monoxide or even residual hydrocarbon vapors. The afterburner 128 may be any of a number of suitable types of second burner assemblies. The burner 128 may be structurally similar to the described burner assembly 10 or to an alternate burner assembly as described below with respect to FIGS. 4 and 5, though it could be a typical state of the art burner. The hot gases which are generated by the operation of the burner assembly 10 perform, after their generation, a function in an industrial process, such as heating, drying or vaporizing pollutants, one of the functions being described with respect to FIG. 2. The purpose of the burner 128 is to cleanse the exhaust gases of unburned elements. Thus, after being drawn from the antechamber 127 into the combustion chamber of the burner 128, the exhaust gases mix with the combustible mixture of fuel and combustion air and are passed through the flame of the afterburner 128. The combustion gases emanating from this latter combustion process are already clean and need not pass through any further filter and are released from the burner 128 through an exhaust chamber-stack assembly 129 to the atmosphere. Some cooling may occur within the exhaust chamber and stack assembly 129. Except for such minor initial cooling, the exhaust from the afterburner 128 is directly released to the atmosphere.

The presence of the afterburner 128 is desirable when, for example, carbon monoxide containing buffer gases are intentionally present in the exhaust to minimize explosion hazards during the use of the exhaust as a drying or heating gas. Carbon monoxide functions as a reducing gas in processes which for example seek to vaporize combustible materials, such as hydrocarbons. Vaporization of hydrocarbons may be expected to some degree in asphalt production processes, and in larger quantities in soil remediation processes. In soil remediation processes the heat of the combustion gases from the burner assembly 10 may be used to remove hydrocarbons from decontaminated soil.

FIG. 2 shows schematically a contemplated arrangement for routing a buffer gas through the duct 101further structural elements which interact advantageously with the burner assembly 10 and the burner system 11 of the apparatus 110 as a whole. FIG. 2 shows schematically an exhaust gas supply line 130 leading from the exhaust stack 126 to a central intake port 131 of a turbo fan 132. At an exhaust port 133 of the turbo fan 132 a damper assembly 134 regulates the external recirculation flow of exhaust gases. Preferably, the damper assembly 134 controls on a real time basis the extent to which cooled exhaust gases may be added through a feed duct 135 to the combustion air forced into the burner assembly 10. The turbo fan 132 allows the cooled recirculated or exhaust gases to be forced at above atmospheric pressure into the upstream end 73 of the combustion chamber. The forced recirculation is preferably matched with the forced supply of turbo combustion air from the turbo blower 18. The feed duct 135 is coupled directly to the supply duct 101, communicating, therefore, with the antechamber 79 formed by the shroud 73 as described with respect to FIG. 1. Thus, the externally recirculated, cool, pre-burned exhaust gases which are added as a buffer to the combustion air are preferably added under the pressure or force generated by the turbo fan 132. On the other hand, the heated, internally recirculated or diverted combustion gases are added by becoming entrained at a pressure less than the stagnation pressure of the combustion gases in the stagnation region 89 of the combustion chamber. Further in reference to FIG. 1, a temperature probe 140 may extend into the flame region 57 to measure the temperature of the flame on a continuous basis. The temperature probe 140, consequently, would be coupled to a control console shown schematically at 141. The control console 141 ("CONTROL") may either be coupled to, or be integrated into, a damper control 142 ("C") which is shown schematically in FIG. 2. The damper control 142 permits a quick response in altering the quantity of the externally recirculated or cooled exhaust buffer gases in response to a change in a metered amount of fuel injected into the burner assembly 10 by the pump 16. Thus, an increase in the amount of fuel desirably results in an immediate increase in the quantity of combustion air and in the quantity of recirculated buffer gases to maintain the flame temperature within a desired range of temperatures. Further adjustments in the quantity of the cooled externally recirculated buffer gases may be made when temperature deviates from the desired range of flame temperatures as registered by the temperature probe 140 shown in FIG. 1. The desired range of flame temperatures lies preferably below 2700 degrees Fahrenheit, above which temperature the generation of nitrous oxides appears to increase. An acceptable range of flame temperatures within which no corrective adjustments would be made might lie, for example, between 2100 degrees and 2500 degrees Fahrenheit.

4. Buffer Recirculation Cooling

Figure 4:
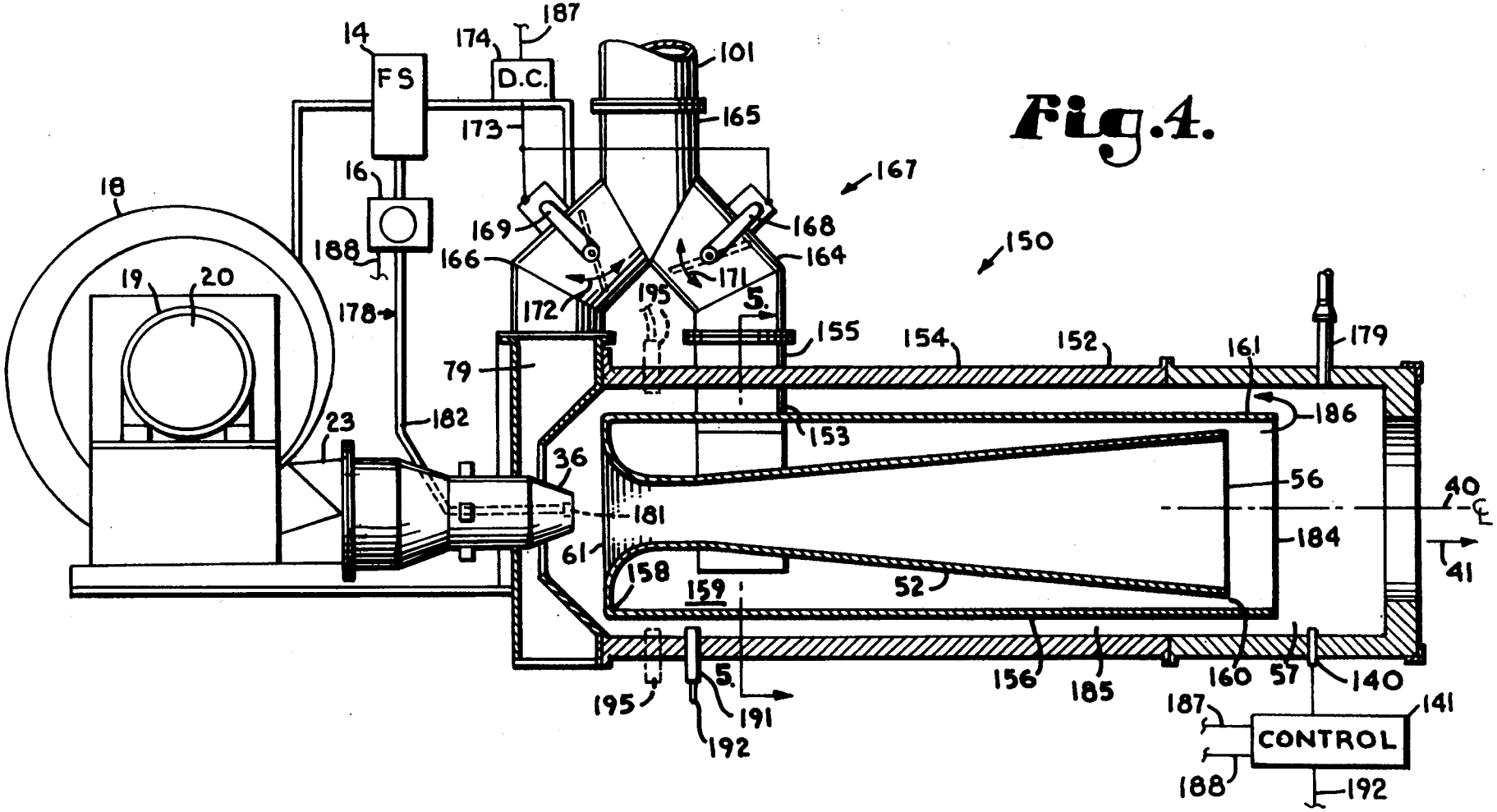
FIG. 4 is a simplified sectional view through a burner assembly similar to that of FIG. 1 but with certain modifications relating to mixing combustion air and preburned buffer gases with fuel.

FIG. 4 shows a modification of the burner assembly 10, the modified burner assembly being designated generally by the numeral 150. It is sought to further improve control over nitrous oxide generation without compromising "blue flame" characteristics of the burner assembly 10. The burner assembly 150 includes a combustion chamber 152 similar to the combustion chamber 21 previously described. The combustion chamber 152 further provides an access port 153 through an outer housing 154 to admit a gas supply duct 155. The combustion tube 52 centered within the outer housing 154 is additionally encased along its length by a cylindrical jacket 156. The annular enclosed space 65 along the length of the combustion tube 52 is thereby modified to a space between the outer housing 154 and the jacket 156. The gas supply duct 155 extends through the port 153 and communicatively opens into the jacket 156. The jacket 156 is sealed against an outer rim 158 of the upstream flared opening 62 of the combustion tube 52, such that the cylindrical jacket 156 and the combustion tube 52 form a unitary subassembly within the outer housing 154. An annular gap 159 between the combustion tube 52 and the jacket 156 functions as a cooling gas conduit. The annular gap 159 decreases in width toward the downstream end 56 of the combustion tube 52. The annular gap 159 leads to an annular opening 160 at the downstream end 56 of the combustion tube 52. The jacket 156 extends in length past the end 56 of the combustion tube 52, forming a downstream extension 161 of the combustion tube 52.

The gas supply duct 155 is coupled to a first branch 164 flow divider duct section 165. A second branch 166 of the divider duct section is coupled to the antechamber 79. Both the antechamber 79 and the gas supply duct 155 are thereby coupled to the gas supply duct 101 which receives cooled combustion gases, as described with respect to the structure shown in FIG. 2, through a supply line 130, for example. The divider duct section 165 preferably includes a flow regulating damper arrangement 167 which may include first and second dampers 168 and 169 as shown in FIG. 4, or a single damper 169 in the branch 166 may be used. The dampers may be separately operable as indicated by the arrows 171 and 172. A control linkage or operating arrangement 173 may be a mechanical actuating mechanism or an electromechanical, hydraulic or pneumatic operating arrangement, schematically shown at 173. The operating arrangement would be actuated by control inputs from a damper control system 174 which is schematically represented by the function box "D.C.".

The burner assembly 150 is further distinguished from the previously described burner assembly 10 by a relocated fuel injection system 178 and a relocated pilot burner assembly 179. The fuel injection system 178 preferably has a fuel atomizing nozzle 181 disposed centrally within the air injector nozzle 36. The fuel supply 14 and the fuel metering pump 16 are coupled through typical fuel lines 182 to the atomizing nozzle 181. The burner system 150 allows for vaporization and mixing of fuel with the combustion gases along the route of the gases and fuel from the air injector nozzle 36 to the flame region 57. Premature ignition is minimized by locating the pilot burner assembly 179 directly within the flame region 57 of the burner assembly 150.

Energy from recirculated gases is used to vaporize fuel during the path of injected fuel from the atomizing nozzle 181 to the flame region. Mixing recirculated, preheated gases with recirculated cool gases at a controllable ratio allows the energy level of the mixed precombustion gases and fuel to be optimized. Recirculated gases introduced through the gas supply duct 155 cool the combustion tube 52, the downstream extension 161 of the combustion tube 52 and the wall of the combustion chamber 152.

Figure 5:
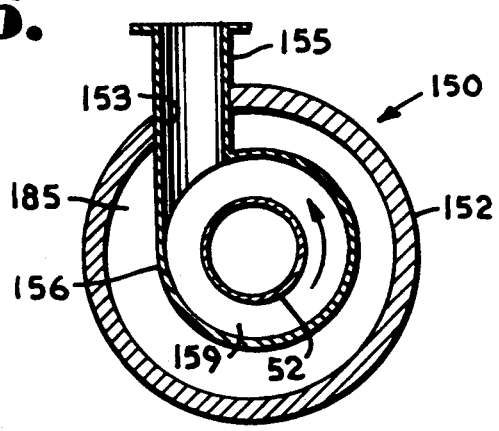
FIG. 5 is a sectional view taken at "5—5" in FIG. 4 and showing details of a duct device for introducing buffer gas into the burner assembly of FIG. 4.

The routing of the cooling gases is best explained in reference to FIGS. 4 and 5. Referring to a section through the burner assembly 150 and particularly the combustion chamber 152, as shown in FIG. 5, the gas supply duct 155 is coupled to introduce recirculated and cooled combustion gases radially offset or tangentially into the gap or space 159 between the combustion tube 52 and the jacket 156. The introduced gases spiral at high velocity within the annular gap 159 about the combustion tube 52 toward the annular opening 160 at the downstream end 56 of the combustion tube 52. Centrifugal forces tend to cause classification of materials including fluids and gases, more dense materials being forced radially outward less dense, hence, hotter gases spiral in circumferentially stratified regions closer to the center of revolution. Thus, the recirculating gases, though being heated by the flame of burning fuel and gases within the downstream extension 161 of the combustion tube 52, nevertheless remain at a lower temperature with respect to other gases of the combustion process within the flame region at the downstream extension 161. The recirculating gases, consequently, continue to spin spiral along the inner wall of the downstream extension 161 toward the end 184 of the jacket 156. Spinning past the end of the jacket 156 the recirculated cooling gases, now already heated, enter the annular space between the outer housing 154 of the combustion chamber 152 and the jacket 156, designated as a gas return flow space 185, in a return flow pattern indicated by arrow 186. As long as the gases remain at a temperature below that of wall portions heated directly by the flame, the gases absorb energy from those wall portions. Continuing to spiral about the flame of the burning gases, the cooling gases absorb energy directly from the burning gases to perform a cooling function while increasing in energy to provide to liquid fuel which is introduced through the atomizing nozzle 181 into the stream of combustion gases.

Not all of the cooling gases introduced through the duct 155 may be returned to the upstream end 61 of the combustion tube 52, since there is necessarily some mixing. However, qualitatively, the now heated cooling gases introduced through the duct 155 are substantially the heated gases which are returned through the annular return flow space 185 to the upstream end 61. It should be understood that the spiralling direction of the cooling gases downstream toward the opening 160 is less significant than the inherent characteristic of remaining substantially in tact as a separate gaseous mass because of the centrifugal motion. These gases, introduced for cooling and to be heated, remain nevertheless cooler than the flame temperature. The centrifugal classification permits the gases to be returned substantially as an intact and separate, heated combustion gas (rich in carbon dioxide, yet deficient or poor in free oxygen) to transfer its energy to any liquid fuel to vaporized the fuel in its path toward the flame region 57. The cooling gases not only cool the combustion tube 52 but also contribute to reduce the flame temperature in boundary heat transfer with the flame in the flame region 57.

Other arrangements for introducing a cool, substantially inert gas into the flame region to reduce the average flame temperature. For example, the gases might be introduced tangentially directly into the flame region 57 of the burner assembly 150 and spiral at high speed counter to the burning gases to enter an annular space and be returned to the upstream end of the combustion tube 52. However, the described arrangement is presently more expedient.

The damper control 174 may be used to control a ratio of cool recirculated gases entering the combustion tube 52 through the antechamber 79 and preheated recirculated gases entering the combustion tube 52 through a preheating loop of the gap 159, and the space 185. Under preferred settings, the preheated, recirculated gases would provide volatilization energy to cause substantially all atomized fuel in the combustion mixture to vaporize on mixing with the recirculated gases and prior to reaching a standing flame in the flame region 57 of the burner assembly 150. Volatilization and mixing of the fuel preparatory to combustion begins with the step of dispersing the liquid fuel from the atomizing nozzle 181 as a mist of small droplets into the stream of turbo combustion air passing through the air injector nozzle 36. The small droplets of fuel begin to vaporize with energy drawn from the stream of combustion air. Further volatilization energy is supplied by the heated, recirculated gases which become entrained into and mix with the stream of combustion air and the fuel at the upstream end 61 of the combustion tube 52. The quantity of heated recirculated air is adjusted to provide the energy needed to vaporize the fuel droplets on their way to the flame region 57. The total quantity of recirculated air is adjusted to lower the flame temperature in the flame region 57 to a temperature at which the generation of nitrous oxides remains at a level to meet requirements. The damper control 174 and the control console 141 may be communicatively coupled or integrated. The control console 141 ("CONTROL") is the master control of the burner which would have a control connection 187 to the damper control 174 as a subcircuit, and a control connection 188 to the fuel metering injection pump 16. Other temperature probes may be used to monitor and control the vaporization of fuel and the energy input to the burner assemblies 10 and 150. In the burner assembly 150, an exemplary temperature probe 191 is coupled via a control line 192 to control console 141. The temperature of the heated recirculated combustion gases may be measured to compute together with a known flow rate from the damper adjustment a total available energy rate from the recirculated gases. The energy rate may be varied when the fuel input to the burner assemblies 10 or 150 are charged at the control console 141.

5. Other Variations of the Described Embodiments

The described structure of the burner assemblies 10 and 150 may be further modified without departing from the scope of the invention. Mixing of the combustion air and the fuel may be enhanced by causing a spin in the combustion air in any number of ways. The adjustable spin vanes for generating a flow component in the combustion air in a plane transverse to the general direction of flow along the axis 40 may be replaced by another arrangement. For example, the tapered front end 96 of the air injector nozzle 36 may be fluted or otherwise shaped to increase the surface area of the combustion air exiting from the air injector nozzle 36 with an increased surface area capable of entraining and mixing with the fuel and recirculating gases. Thus, a substantially complete mixture of the fuel elements and the oxygen in the combustion air may be present at the time when the combustion process is initiated.

As an alternate location for fuel injection, instead of having the atomizing nozzle 181, fuel injection nozzles 195 may be peripherally spaced within the outer housing 154 adjacent the upstream end of the Combustion tube 52, as shown in phantom lines in FIG. 4. The injected fuel would then be mixed with the heated gases just before becoming entrained in and mixed with the high velocity stream of turbo air injected into the upstream end 61 of the combustion tube 52.

Various other changes and modifications in the structure of the described embodiment are possible without departing from the spirit and scope of the invention as defined by the terms of the claims appended hereto and reasonable equivalents thereof.

What is claimed is:

1. A burner assembly comprising:

a combustion chamber including an outer housing and an inner, elongate combustion tube disposed spacedly from and centrally within the outer housing, the outer housing forming an annular enclosed space along the length of the combustion tube, the combustion tube having upstream and downstream ends;

a flame region extending from the downstream end of the combustion tube into the outer housing of the combustion chamber;

means for injecting a high velocity stream of combustion air into the upstream end of the combustion tube to flow through the combustion tube in a direction toward the flame region of the combustion chamber;

means for injecting liquid fuel into the combustion chamber to be entrained in and become mixed with the combustion air before the combustion air enters the combustion tube;

an exit opening formed in the outer housing downstream of the downstream end of the combustion tube, the exit opening being bounded peripherally by a pressure increasing ledge for diverting heated combustion gases from the flame region of the combustion chamber to flow counter to the direction of flow in the combustion tube through the annular enclosed space about the combustion tube toward the upstream end of the combustion tube;

flow directing means at the upstream end of the combustion tube and communicating with the annular space about the combustion tube for directing the diverted combustion gases from the annular space to become entrained in and mixed with a stream of combustion air injected into the combustion tube; and means for combining and mixing a buffer gas with diverted combustion gases to become entrained in and mixed with the stream of combustion air and with combustion fuel, the diverted combustion gases providing energy for vaporizing the combustion fuel prior to burning the mixture of combustion air and fuel in the presence of the mixed buffer gas within the flame region of the combustion chamber.

2. The burner assembly according to claim 1, wherein the means for combining and mixing the buffer gas comprises means for measuring the flame temperature in the flame zone of the combustion chamber, and means for controlling the quantity of the buffer gas to be entrained in and mixed with the combustion air to maintain the flame temperature within a predetermined range of temperatures.

3. The burner assembly according to claim 1, wherein the means for injecting liquid fuel is located so that the liquid fuel is injected into the heated diverted combustion gases and becomes entrained in and mixed with the combustion air together with the heated combustion gases.

4. The burner assembly according to claim 3, wherein the means for combining and mixing the buffer gas comprises means for measuring the flame temperature within the flame zone of the combustion chamber, an adjustable damper for controlling the quantity of buffer gas, and means for adjusting the damper in response to a deviation of a measured flame temperature from a desired temperature range.

5. The burner assembly according to claim 1, wherein the means for injecting liquid fuel is located so that the liquid fuel becomes dispersed into the stream of combustion air and the heated diverted combustion gases are entrained into a mixture of combustion air and dispersed liquid fuel to vaporize the fuel.

6. The burner assembly according to claim 1, comprising a cylindrical jacket disposed about the combustion tube and forming an annular cooling conduit with the combustion tube, the annular cooling conduit having an annular opening adjacent the downstream end of the combustion tube, and means for introducing cool recirculated combustion gases tangentially into the cooling conduit to move in a circular path about the combustion tube toward the annular opening, thereby becoming heated while cooling the combustion tube, the pressure increasing ledge diverting the heated combustion gases into the annular enclosed space.

7. The burner assembly according to claim 6, wherein the means for combining and mixing an oxygen deficient buffer gas is a means for combining and mixing cool recirculated combustion gases, the means including a flow divider coupled to a cool combustion gas supply, the flow divider having a branch duct coupled to the means for introducing cool recirculated combustion gases tangentially into the cooling conduit, the flow divider including means for controlling a quantity of the gases combined and mixed as a cool buffer gas and of the gases introduced tangentially into the cooling conduit.

8. The burner assembly according to claim 7, wherein the means for controlling the quantity of the gases comprises at least one damper assembly means for changing a ratio of the gases combined and mixed as a cool buffer gas to the gases introduced into the cooling conduit, temperature sensing means for sensing the temperature of a flame within the flame region of the combustion chamber, and control means for adjusting the at least one damper assembly means in response to a sensed temperature outside a predetermined desirable temperature range.

9. The burner assembly according to claim 8, wherein the means for injecting liquid fuel comprises means for injecting liquid fuel through an atomizer nozzle into the stream of combustion air before the stream of combustion air mixes with the heated combustion gases.

10. The burner assembly according to claim 9, wherein the jacket extends downstream beyond the downstream end of the combustion tube, the introduced combustion gases circulating along an inner wall of the jacket, thereby cooling the extended jacket and absorbing energy from burning fuel within the flame region.

11. The burner assembly according to claim 9, further including means for monitoring the temperature of the diverted combustion gases prior to becoming entrained in and mixing with the stream of combustion air.

12. A burner assembly comprising:

a combustion chamber including therein an elongate combustion tube having upstream and downstream ends, the combustion chamber having a flame region within a downstream end portion of the combustion tube and extending downstream beyond the downstream end;

means for directing a high velocity stream of combustion air from the upstream end through the combustion tube;

means for returning heated gases from the flame region to the upstream end of the combustion tube;

means for mixing liquid fuel and returned, heated gases with the combustion air at the upstream end of the combustion tube, whereby energy from the heated gases is transferred to the liquid fuel to vaporize the liquid fuel prior to the liquid fuel being carried by the stream of combustion air to the flame region; and a cooling jacket disposed about the combustion tube, the cooling jacket bounding an annular space about the combustion tube and including means for receiving and centrifugally spiraling cooling gases through the annular space and along the flame region thereby cooling the combustion tube and heating the spiraling gases, and for transferring heated cooling gases to the means for returning heated gases from the flame region to the upstream end of the combustion tube.

13. The burner assembly according to claim 12, wherein the means for directing a high velocity stream of combustion air through the combustion tube comprises a turbo-burner assembly including an air injection nozzle having a nozzle opening directed into the upstream end of the combustion tube.

14. The burner assembly according to claim 13, further including means for supplying oxygen deficient buffer gases to the upstream end of the combustion tube to become entrained in and mixed with combustion air flowing into the upstream end of the combustion tube.

15. The burner assembly according to claim 14, wherein the means for mixing liquid fuel and the heated gases comprises a fuel supply, and an atomizing nozzle disposed centrally in the air injection nozzle for introducing a spray of droplets of liquid fuel into the stream of combustion air.

16. The burner assembly according to claim 12, wherein the combustion chamber further comprises a cylindrical outer housing disposed spacedly about the cooling jacket, and the means for returning heated gases from the flame region to the upstream end of the combustion tube comprises a peripheral ledge downstream from the downstream end of the combustion tube, the peripheral ledge forming an exit opening for a flame and a stream of hot gases to exit from the flame region of the combustion chamber and forming an annular region of stagnation about the opening for building a stagnation pressure in gases disposed peripherally about hot gases exiting from the combustion chamber, thereby directing the peripherally disposed gases to return along the inner wall of the housing toward the upstream end of the combustion tube.

17. The burner assembly according to claim 16, wherein the means for mixing liquid fuel comprises at least one fuel injection nozzle disposed in the outer housing adjacent the upstream end of the combustion tube.

18. A method of generating a stream of hot combustion gases comprising:

directing a stream of combustion air into a combustion chamber and into an upstream end of a combustion tube disposed in the combustion chamber to move toward a flame region at a downstream end of the combustion tube within the combustion chamber;

injecting liquid fuel adjacent the upstream end of the combustion tube into the combustion chamber, mixing the injected fuel into the stream of combustion air and burning the fuel with the combustion air in the flame region of the combustion chamber;

moving oxygen deficient cooling gas peripherally in a spiralling motion about the combustion tube and peripherally along the flame region, thereby heating the cooling gas with heat energy from the combustion tube and from burning fuel in the flame region;

returning heated cooling gas to the upstream end of the combustion tube, mixing the fuel with the heated returned cooling gas to vaporize the fuel while mixing the fuel with the cooling gas and the stream of combustion air within the combustion tube;

mixing a controlled quantity of a buffer gas at the upstream end of the combustion tube with the returned heated cooling gas, the fuel and the stream of combustion air;

monitoring the flame temperature of the burning mixture; and adjusting the quantity of the buffer gas to maintain the flame temperature within a range of desirable temperatures.

19. The method according to claim 18, wherein moving oxygen deficient cooling gas peripherally in a spiralling motion about the combustion tube and peripherally along the flame region comprises:

moving oxygen deficient cooling gas peripherally in a spiralling motion through an annular enclosed space between the combustion tube and an encasing cylindrical jacket from adjacent the upstream end of the combustion tube toward an annular opening between the jacket and the combustion tube at the downstream end of the combustion tube and along an inner surface of an extension of the jacket past the downstream end of the combustion tube along the flame region.

* * * * *

UNITED STATES PATENT AND TRADEMARK OFFICE

CERTIFICATE OF CORRECTION

PATENT NO. : 5,388,985

DATED : February 14, 1995

INVENTOR(S) : Musil et al.

It is certified that error appears in the above-identified patent and that said Letters Patent is hereby corrected as shown below:

On the Title page, item [56], References Cited, delete "Anacona" and insert therefor --Ancona--.

Column 6, line 21: after "to", delete the numeral "4".

Column 6, line 51: after the second "the", delete the numeral "4".

Column 13, line 56: delete "charged" and insert therefor --changed--.

Signed and Sealed this

Second Day of May, 1995

*Attest:*

*Attesting Officer*

BRUCE LEHMAN

*Commissioner of Patents and Trademarks*